US008062101B1

(12) United States Patent
Friend

(10) Patent No.: US 8,062,101 B1
(45) Date of Patent: Nov. 22, 2011

(54) SANDING GLOVE

(76) Inventor: Joseph M. Friend, Yuba City, CA (US)

( * ) Notice: Subject to any disclaimer, the term of this patent is extended or adjusted under 35 U.S.C. 154(b) by 849 days.

(21) Appl. No.: 11/975,316

(22) Filed: Oct. 18, 2007

(51) Int. Cl.
*A41D 19/015* (2006.01)
*B24D 11/00* (2006.01)

(52) U.S. Cl. ..... 451/523; 2/161.8; 15/227; 15/104.94; 451/538; 451/539

(58) Field of Classification Search ..... 2/158, 160, 2/161.6, 161.8; 15/104.94, 227; 451/523, 451/526, 538, 539
See application file for complete search history.

(56) References Cited

U.S. PATENT DOCUMENTS

| | | | | |
|---|---|---|---|---|
| 3,151,333 | A * | 10/1964 | Scholz | 2/161.8 |
| 3,748,792 | A * | 7/1973 | Lamb | 451/523 |
| 3,789,555 | A | 2/1974 | Means | 451/523 |
| 3,885,249 | A * | 5/1975 | De Brabander | 15/227 |
| 5,642,527 | A * | 7/1997 | Savage | 2/161.8 |
| 5,885,148 | A | 3/1999 | Vargas et al. | 451/523 |
| 5,956,770 | A * | 9/1999 | Dennis | 2/160 |
| 6,016,571 | A * | 1/2000 | Guzman et al. | 2/167 |
| 6,395,656 | B1 * | 5/2002 | Jin et al. | 442/159 |
| 6,557,178 | B1 * | 5/2003 | Hoover | 2/161.6 |
| 6,575,822 | B2 | 6/2003 | Lowe et al. | 451/526 |
| 6,604,244 | B1 | 8/2003 | Leach | 2/161.6 |
| D479,972 | S * | 9/2003 | Cueto | D8/90 |
| 2002/0009966 | A1 | 1/2002 | Orr | 451/523 |
| 2002/0193060 | A1 * | 12/2002 | Lowe et al. | 451/538 |
| 2004/0063390 | A1 | 4/2004 | Codd | 451/523 |
| 2005/0060786 | A1 | 3/2005 | Ran | 2/161.6 |
| 2005/0097654 | A1 | 5/2005 | Ran | 2/161.6 |
| 2006/0211352 | A1 * | 9/2006 | Adams | 451/523 |
| 2008/0090506 | A1 * | 4/2008 | Palushaj | 451/538 |
| 2008/0244848 | A1 * | 10/2008 | Firouzman | 15/118 |

FOREIGN PATENT DOCUMENTS

| | | |
|---|---|---|
| GB | 2260899 | 5/1993 |
| GB | 2368776 | 5/2002 |

* cited by examiner

*Primary Examiner* — Timothy V Eley
(74) *Attorney, Agent, or Firm* — Price & Adams

(57) ABSTRACT

A glove body, a barrier, and an abrasive layer form a flexible sanding device that fits over the hand of user to perform complex sanding operations on intricate or detailed objects. The glove body includes a palm portion, a plurality of finger portions, and a thumb portion. The finger portions and the thumb portion extend from the palm portion to form a continuous inner surface. The inner surface is covered by the barrier and is coextensive with the abrasive layer. The barrier is permanently attached to the glove body on one surface. The abrasive layer is releasably attached to the opposite surface of the barrier. The barrier is permanently attached to the glove body with a permanent adhesive or through sewing. The abrasive layer is releasably attached to the barrier through a releasable adhesive or through a hook and loop fastener.

19 Claims, 6 Drawing Sheets

SANDING GLOVE

BACKGROUND OF THE INVENTION

1. Field of the Invention

This invention relates a method and apparatus for sanding an object and, more particularly, to a sanding glove having a permanent barrier that facilitates releasable connection to an abrasive layer.

2. Description of the Related Art

Sanding tools are essential for many trades from woodworking to drywall to automobile restoration. Currently there are several hand-sanding tools on the market including various hand held tools and abrasive gloves. These tools are limited in their ability to withstand the wear and tear associated with the repeated replacement of abrasive materials that wear out during sanding operations.

U.K. Patent Application No. 2 368 776 discloses a sanding glove or mitten that includes hook and loop fasteners. The fasteners connect to pads on the fingers, the thumb, and the palm of a hand. The pads are effectively hinged together by the glove fabric to allow free movement of the fingers and hand. In one embodiment, the entire gripping face of the glove is formed from the hook and loop fastener. In another embodiment, a patch is provided on the rear of the glove to facilitate attachment of spare sanding pads. The sanding surface does not conform to configuration of a human hand.

U.S. Patent Publication No. 2004/0063390 discloses a hand sanding apparatus. The sanding apparatus includes a glove, a platform or block, and abrasive sheeting. The glove is semi-rigid and is removably attached to the platform. The abrasive sheeting is mounted on the platform. The glove utilizes a wrist strap to attach to the wrist of a user.

U.S. Patent Publication No. 2002/0009966 discloses a sanding glove that is covered with embedded abrasive materials. The abrasive materials include silica or aluminum oxide. The glove is flexible. The abrasive materials are attached directly to the glove outer surfaces, so that the glove must be discarded when the abrasive materials wear off of the glove outer surface.

U.S. Pat. No. 3,789,555 discloses a glove made from paper or cotton. The glove is impregnated with epoxy resin and coated with an abrasive material. The glove is configured so that it can be worn on both the right and left hands making the palm and digital sections reversible, so that all portions of the glove contain working surfaces.

U.S. Patent Publication Nos. 2005/0060786 and 2005/0097654 disclose a glove that includes a glove body that is adapted for receiving a hand of a user. The glove body includes a palm portion and finger portions that extend from the palm portion. The glove body also includes a surface treatment arrangement that has a treatment pad adapted to provide a treating action positioned on the palm portion of the glove body. The glove also includes a treatment member adapted to provide another treating action that includes a fastener to connect to the treatment pad.

U.S. Pat. No. 5,885,148 discloses a reusable flexible handheld mitten. The mitten attaches to one or more layers of abrasive, cleaning, or polishing material. The material is attached to the glove through a non-permanent, pressure-sensitive, and moisture-resistant adhesive, which has been applied to the back of the material. The abrasive, cleaning, or polishing material is peeled off as needed either to expose fresh material or to attach new material to the face of the mitten.

U.S. Pat. No. 6,604,244 discloses a work glove for multipurpose uses. The work glove includes at least one glove member for positioning on a hand of a user. The glove member includes a wrist portion, a palm portion, and a plurality of digit portions. The glove member has a front surface and a back surface. A plurality of hook and loop fasteners sections are fixedly coupled to the front surface of the glove member. The hook and loop fastener sections include a palm fastener section and a plurality of digit fastener sections. A plurality of pads releasably attaches to the hook and loop fastener sections. The plurality of pads comprises a palm pad and a plurality of digit pads for selectively coupling to the palm fastener section and the digit fastener sections respectively. A fastening apparatus secures the glove member to the hand of the user.

U.S. Pat. No. 6,575,822 discloses a sanding glove having glove portion, a sanding portion, and a device for releasably securing the sanding portion to the glove portion. The user treats a surface of an object by rubbing the sanding portion against the object. The securing device includes a plurality of grooves extending through the palm area of the glove portion and a plurality of protrusions extending from a first side of the sanding portion. The glove portion is fabricated from a flexible material. The sanding portion includes a semi rigid pad. The grooves facilitate bending of the pad.

U.K. Patent Application No. 2 260 889 discloses an ambidextrous protective glove having a releasably attached layer of resilient material to the outer surface. An abrasive material is releasably attached to the layer of resilient material. The resilient material has a thickness of at least 1 mm, preferably between 2 mm and 15 mm. The abrasive material is releasably attached using convention attachment means, such as pressure sensitive adhesives or through a hook and loop fastener.

The above-described devices have limitations that adversely affect their efficiency, versatility, and maneuverability. Utilizing a sanding tool that is efficient, versatile, and easily maneuverable is important for all fields that employ sanding methods. Accordingly, there is a need for a sanding tool that is comfortable, inexpensively manufactured, and capable of completing small or large projects.

SUMMARY OF THE INVENTION

In accordance with the present invention there is provided a sanding glove having a glove body for receiving a hand of a user. The glove body has a palm portion, a plurality of finger portions, and a thumb portion. The finger portions and the thumb portion extend from the palm portion to form a continuous inner surface. An abrasive outer layer is positioned over the glove body coextensive with the inner surface. A flexible barrier is positioned between the abrasive outer layer and the glove body. The flexible barrier is permanently attached to the glove body. The abrasive outer layer releasably attaches to the flexible barrier to facilitate replacement of the abrasive outer layer from the glove body.

Further in accordance with the present invention, there is provided a sanding device. A flexible glove includes a palm portion, a back hand portion, and a plurality of digit receiving members connecting the palm to the back hand portion so that the glove essentially covers a hand of a user. A flexible barrier permanently attaches to the flexible glove to cover the palm area and at least one side of each of the digit receiving members. An abrasive outer layer covers the flexible barrier. Means for releasably connecting the abrasive outer layer to the flexible barrier facilitate replacement of the abrasive layer.

Further in accordance with the present invention, there is provided a method for assembling a device for sanding an object. A sanding glove having a palm portion, a thumb portion, a plurality of finger portions, and a continuous surface extending from one side of the palm portion to the thumb portion and the finger portions are provided. A barrier layer having a groove-free outer surface is aligned in overlying relationship with the sanding glove continuous surface. The barrier layer permanently attaches to the sanding glove while providing the sanding glove with sufficient flexibility to allow the thumb portion and at least one of the finger portions to surround the object at least partially. An abrasive outer layer having a plurality of abrasive particles releasably attaches to the flexible barrier groove-free outer surface so that the abrasive particles are coextensive with the glove continuous surface.

Accordingly, a principal object of the present invention is to provide a sanding device that includes a flexible pad attached to a glove.

Another object of the present invention is to provide a sanding glove that includes a flexible pad that facilitates replacement of abrasive materials.

Another object of the present invention is to provide an inexpensive sanding glove that includes a pad having sufficient flexibility to allow the glove to surround a work piece during sanding operations.

A further object of the present invention is to provide a sanding glove that has a flexible pad that releasably connects to die cut abrasive sheets.

These and other objects of the present invention will be more completely described and disclosed in the following specification, accompanying drawings, and appended claims.

DESCRIPTION OF THE PREFERRED EMBODIMENTS

Figure 1:
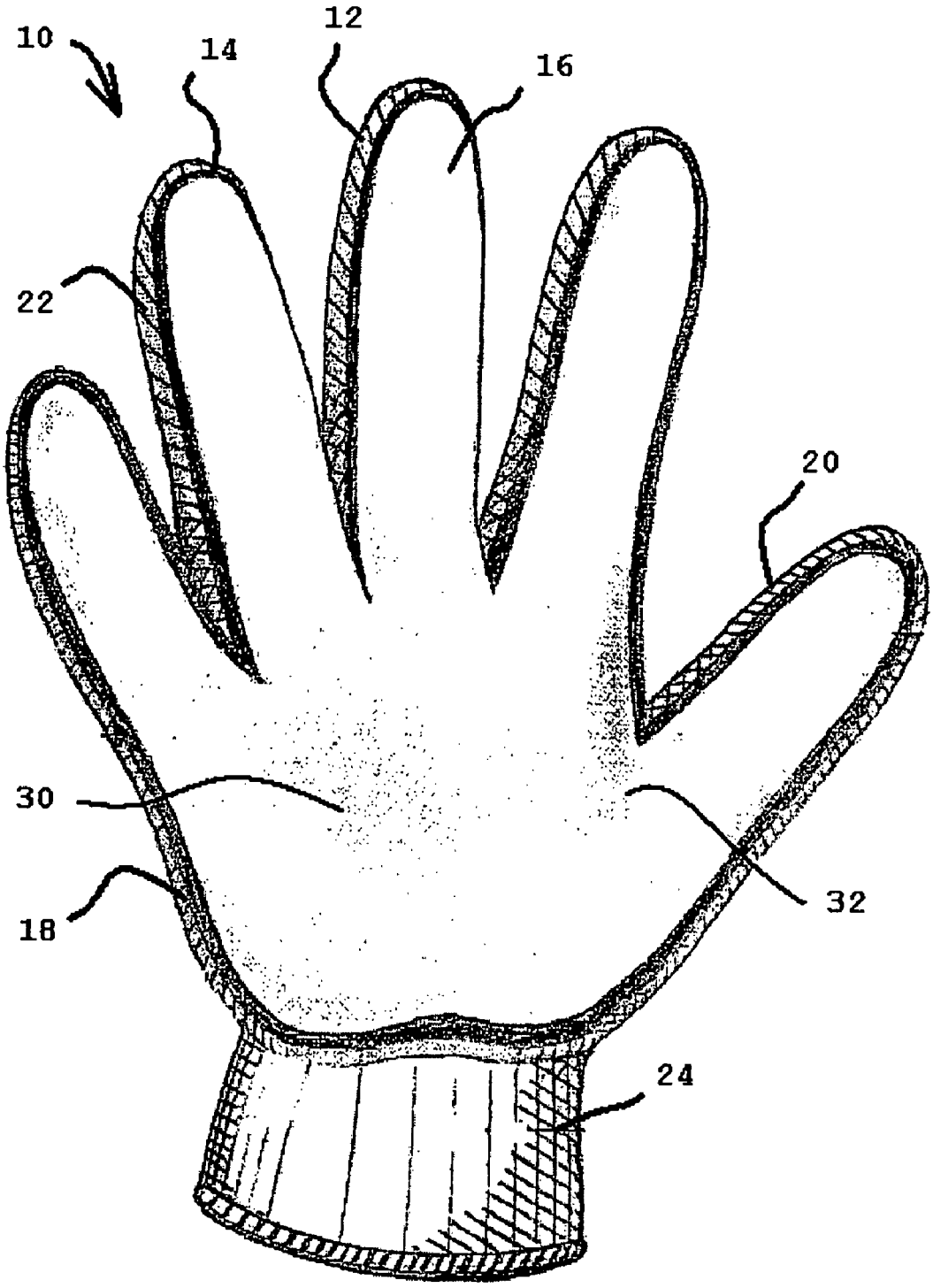
FIG. 1 is an isometric view of a sanding glove.

Referring to the drawings and, particularly, to FIGS. 1-7, there is illustrated an improved tool for gripping and sanding objects generally designated by the numeral 10. The tool 10 is relatively thin, flexible, strong, and is specially adapted for gripping objects and surrounding those objects to perform complex sanding operations, including auto body detailing operations, finishing operations for baseboards and door casings, and sanding operations for radius corners. The tool 10 also performs sanding operations on intricate or detailed objects.

Referring now to FIG. 1, the tool 10 includes a flexible glove or glove body 12, a flexible barrier 14, and an abrasive layer 16. The barrier 14 permanently attaches to the glove 12 to allow for releasably connecting the abrasive outer layer 16 to the flexible barrier 14. The permanent connection between the glove 12 and the barrier 14 prevents slippage of the barrier 14 with respect to the glove 12. The permanent connection also provides support for the abrasive layer 16 during sanding operations.

The abrasive layer 16 releasably attaches to the barrier 14 to facilitate replacement of the abrasive layer 16 after excessive wear. The releasable connection between the barrier 14 and the abrasive layer 16 also prevents the abrasive layer 16 from being dropped during sanding operations that are performed on high scaffolds, which commonly occurs during such sanding operations that use sandpaper alone. The releasable connection also facilitates changing of grit sizes or to different abrasive materials. The use of a releasable connection is more cost-effective because routine replacement of abrasive layers 16 is more cost effective than the replacement of the entire tool 10.

As shown in FIG. 1, the glove 12 includes a palm portion 18, a thumb portion 20, a plurality of finger portions 22, and a wrist portion 24. The thumb portion 20 and the finger portions 22 extend from the palm portion 18. The palm portion 18 connects to the wrist portion 24.

The wrist portion 24 is an essentially cylindrical tube that receives a hand (not shown) of user to facilitate insertion of the hand into the glove 12. The hand is inserted through the wrist portion 24 into the palm portion 18 with fingers being inserted into the glove finger portions 22 and a thumb being inserted into the glove thumb portion 20. The wrist portion 24 includes a band that grips the wrist of the hand to hold the glove 12 onto the hand.

The glove 12 is a typical, commercially available glove that is provided in sizes that fit various hand sizes, ranging from extra-extra-small (XXS) to extra-extra-extra-large (XXXL) or greater. Alternatively, the glove 12 is customized to fit the size of a preselected user.

The glove 12 is made from any suitable flexible material through any suitable manufacturing process. The glove 12 has sufficient flexibility to allow the thumb portion 20 to oppose the finger portions 22 after a hand is inserted into the glove 12. Preferably, the glove 12 is made from cotton.

Figure 2:
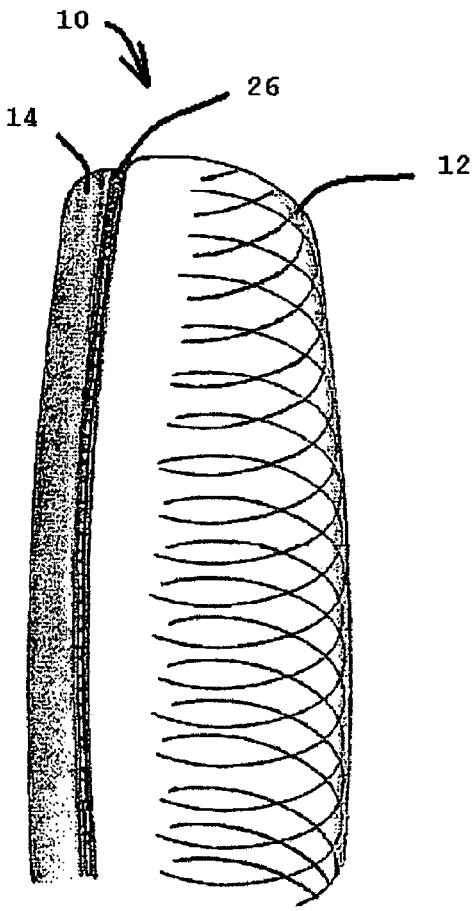
FIG. 2 is a fragmentary side view of a barrier pad attached to a glove with an adhesive.
Figure 3:
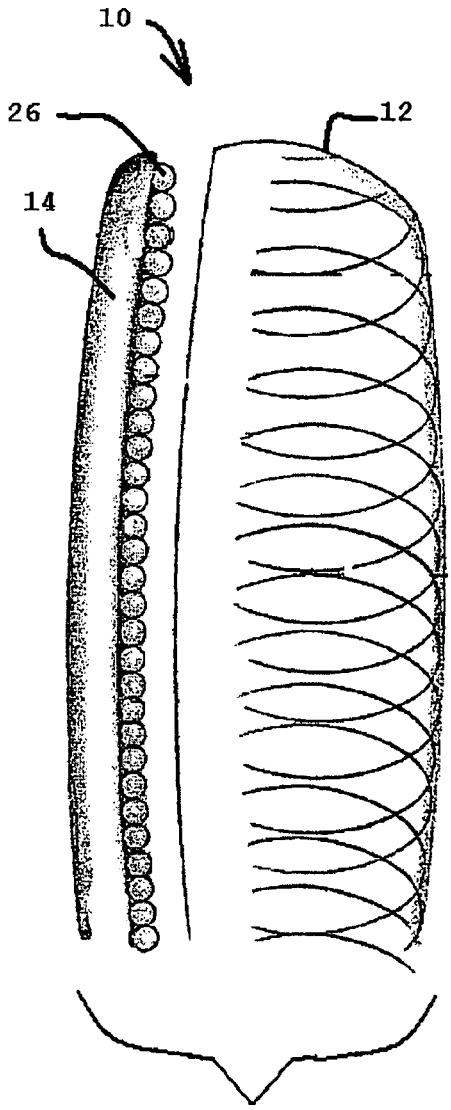
FIG. 3 is an exploded fragmentary view of the barrier pad and the glove shown in FIG. 2.

Referring now to FIGS. 1-3, the tool 10 includes an adhesive layer 26 positioned between the barrier 14 and the glove 12. The adhesive layer 26 is formed by inserting adhesive material before pressing the barrier 14 against the glove 12. The adhesive material cures to permanently attach the glove 12 to the barrier 14 to form a permanent connection that prevents slippage and provides support.

The barrier 14 and the adhesive layer 26 are formed from any suitable compatible materials that can be joined to one another to form a permanent connection. Suitable adhesive materials include thermoplastics, thermosets, or elastomeric materials.

The barrier 14 is made from a material that allows the abrasive layer 16 to be replaced multiple times without tearing. Suitable barrier materials include flexible materials that facilitate a permanent connection to the glove 12 and a releasable connection with the abrasive layer 16, such as flexible synthetic foams, flexible rubbers, flexible natural materials, and thermoplastic materials. Preferably, the barrier 14 is made from laminated floor underlayment materials.

The barrier 14 is relatively thin with a thickness ranging from 0.5 mm to 5 mm. Preferably, the thickness is between 1 mm and 3 mm.

Figure 4:
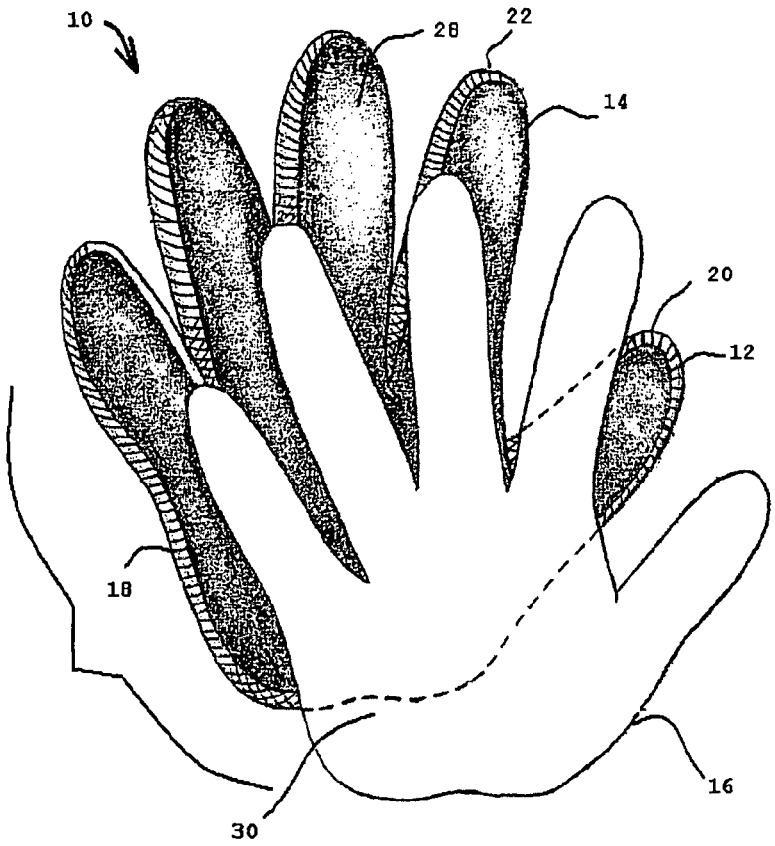
FIG. 4 is an exploded isometric view of the sanding glove shown in FIG. 1.
Figure 5:
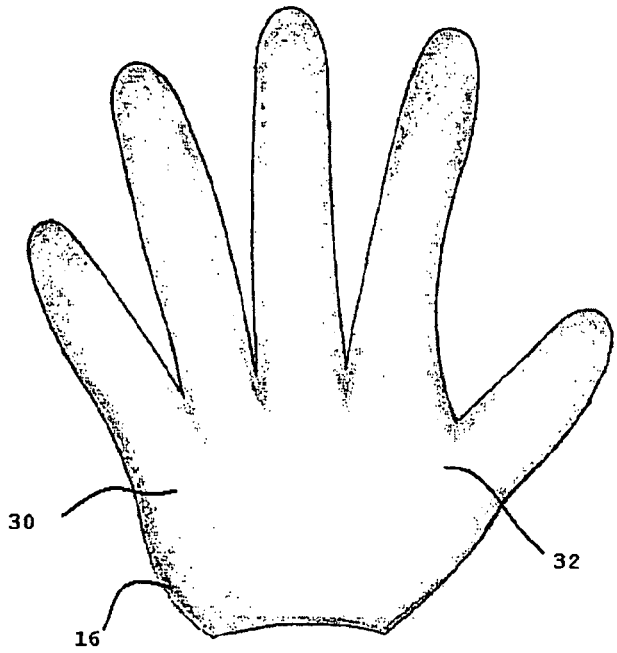
FIG. 5 is an isometric view of an abrasive sheet cut for the sanding glove shown in FIG. 1.
Figure 6:
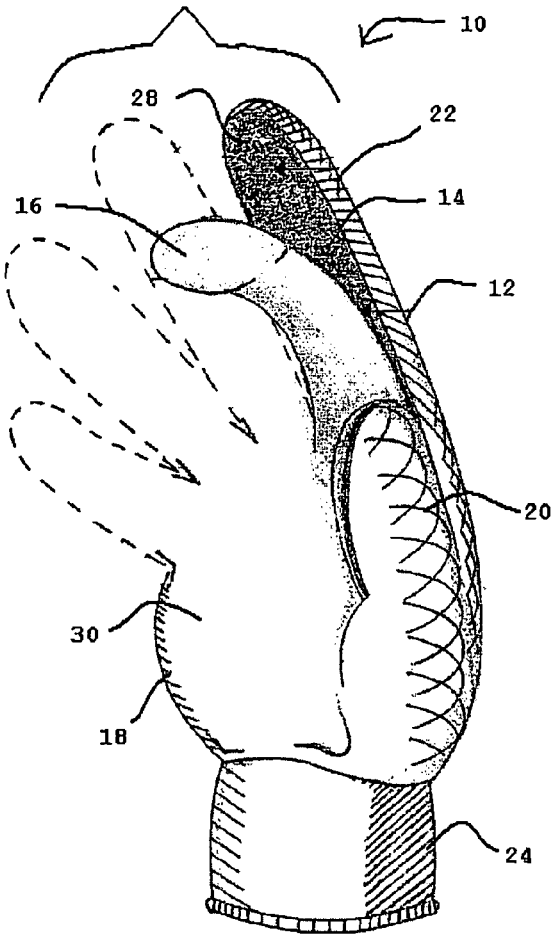
FIG. 6 is an exploded fragmentary isometric view of the sanding glove, illustrating the releasable connection of the abrasive sheet to the sanding glove barrier with an adhesive.
Figure 7:
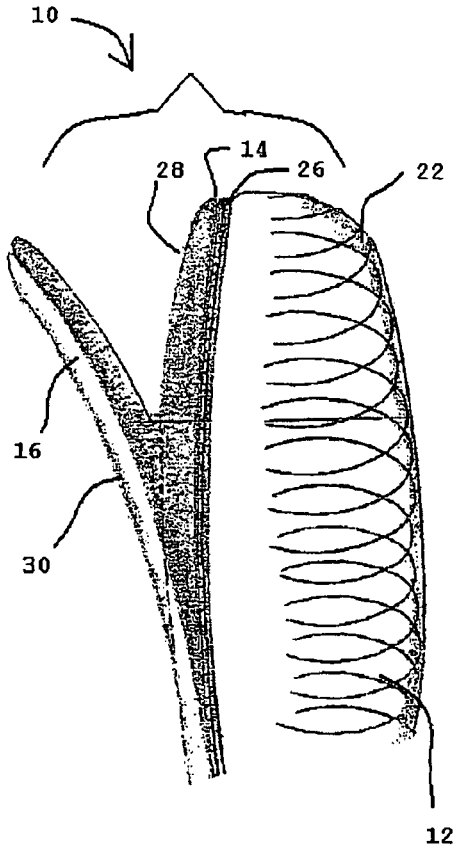
FIG. 7 is a fragmentary side view of the sanding glove, illustrating the connection of the abrasive sheet to the sanding glove barrier.

Referring now to FIGS. 4-5, the barrier 14 is essentially a flexible pad that connects to the palm portion 18, the thumb portion 20, and the finger portions 22 to form a continuous surface 28 for receiving the abrasive layer 16. The surface 28 is essentially free from grooves or recesses. The barrier 14 has sufficient flexibility to allow the thumb portion and the finger portion 22 to grip objects during sanding operations.

As shown in FIG. 4, the abrasive layer sanding surface 30 is essentially coextensive with the palm portion 18, the thumb portion 20, and the finger portion 22 of the glove 12. The sanding surface 30 is also essentially coextensive with the barrier surface 28, so that the barrier surface 28 and the glove sanding surface 30 have an outer configuration that has the same contour as the glove 12.

The abrasive layer 16 forms an outer polishing or sanding surface 30 for performing sanding operations. The sanding surface 30 includes a web 32 between the thumb portion 20 and one of the finger portions 22 to facilitate the sanding of corners and other hard to reach places.

As shown in FIG. 5, the abrasive layer 16 is formed from thin sheets covered by abrasive particles that conform to the outer configuration of the glove 12, as shown in FIG. 5. The sheets are provided in a pre-cut form or are cut to fit during the assembly of the tool 10. The sheet 16 is shaped through a suitable cutting operation that conform the sheet 16 to the contour of the barrier outer surface 28. Preferably, the sheet 16 is formed through a die cutting operation.

Referring now to FIGS. 4-7, the sheet 16 releasably attaches to the barrier outer surface 28 to facilitate replacement. The pre-cut sheet 16 is aligned in an overlying relationship with the barrier outer surface 28, so that the outer configuration of the abrasive layer 16 conforms to the outer configuration of the glove 12. Once the sheet 16 is aligned with the barrier outer surface 28, the sheet 16 is pressed against the outer surface 28 until the sheet 16 is connected to the barrier 14.

The releasable connection between the barrier 14 and the sheet 16 is sufficient to prevent the sheet 16 from slipping during sanding operations. The barrier 14 also supports the sheet 16 during sanding operations. The barrier 14 also provides the glove 12 with sufficient flexibility to allow the thumb portion 20 and at least one of the finger portions 22 to surround work pieces or objects (not shown) at least partially during sanding operations.

The releasable connection between the barrier 14 and the sheet 16 is formed from any suitable releasable adhesive material. The adhesive material is applied to the barrier 14 or the sheet 16 through any suitable process to form the releasable connection. Preferably, the sheet 16 includes a peel-and-stick adhesive that forms the releasable connection to the barrier 14.

Figure 8:
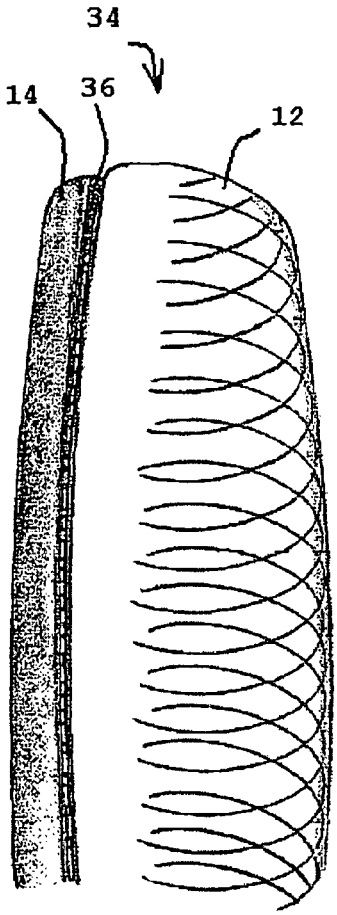
FIG. 8 is a fragmentary side view of another embodiment of a barrier pad sewn to a glove.
Figure 9:
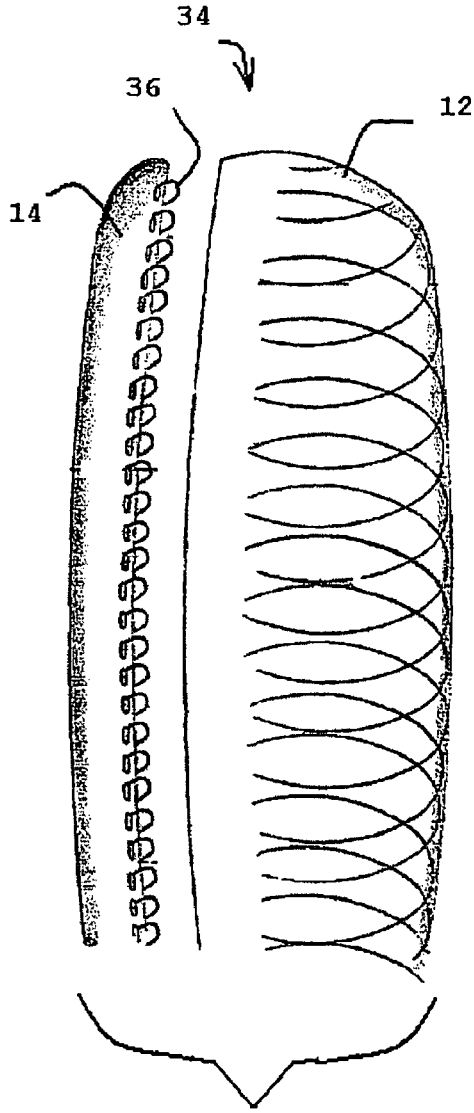
FIG. 9 is an exploded fragmentary view of the barrier pad and the glove shown in FIG. 8.

Referring now to FIGS. 8-9, there is shown another embodiment of a sanding tool, generally designated by the numeral 34, in which like elements are identified by like numerals shown in FIGS. 1-7. The tool 34 includes a glove 12, a barrier 14, and an abrasive sheet 16 that are identical to the glove 12, barrier 14, and the abrasive sheet 16 shown in FIGS. 1-7. The glove 12 is permanently connected to the barrier 14. The barrier 14 is releasably attached to the abrasive sheet 16.

Contrary to the embodiment shown in FIGS. 1-7, the tool 34 does not include an adhesive layer between the glove 12 and the barrier 14. Rather the barrier 14 and the glove 12 are sewn together with a plurality of stitches 36, as shown in FIG. 9. The stitches 36 prevent the barrier 14 from sliding against the glove 12 during sanding operations. The stitches 36 also facilitate the support of the abrasive sheet 16 by the barrier 14.

Figure 10:
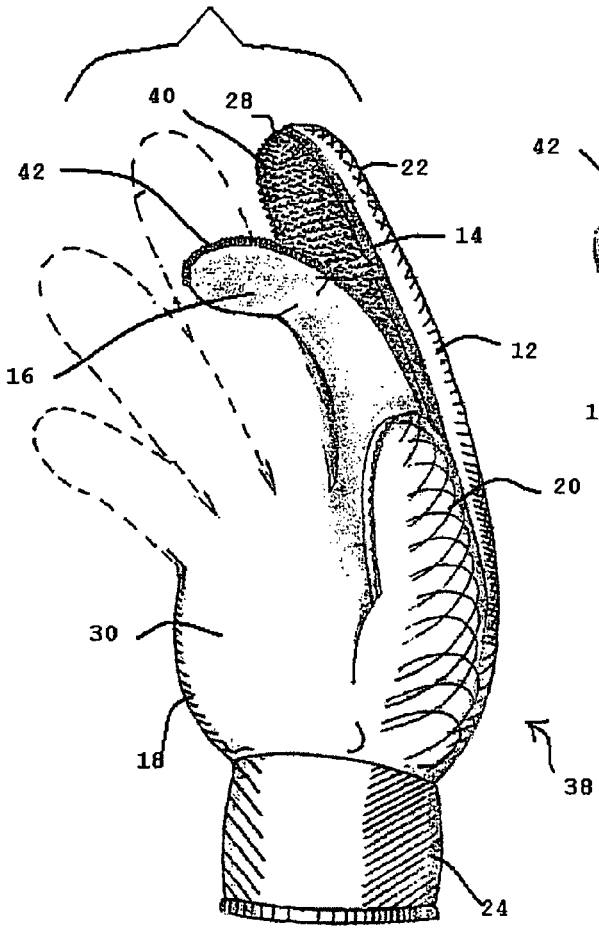
FIG. 10 is an exploded fragmentary isometric view of another embodiment sanding glove, illustrating the connection of an abrasive sheet to a sanding glove barrier through a hook and loop fastener.
Figure 11:
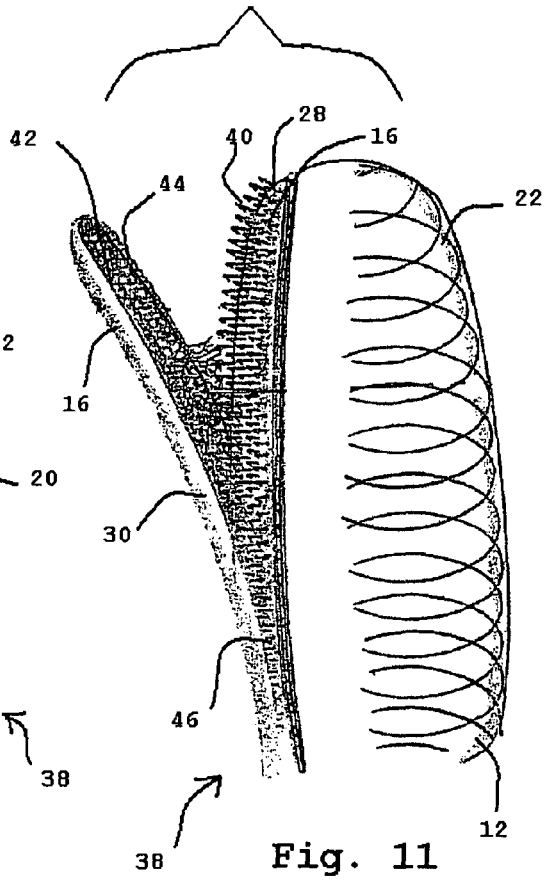
FIG. 11 is an exploded fragmentary side view of the embodiment of the sanding glove shown in FIG. 10, illustrating the connection of the abrasive sheet to the sanding glove barrier with a hook and loop fastener.

Referring now to FIGS. 10-11, there is shown another embodiment of a sanding tool, generally designated by the numeral 38, in which like elements are identified by like numerals shown in FIGS. 1-9. The tool 34 includes a glove 12, a barrier 14, and an abrasive sheet 16 that are identical to the glove 12, barrier 14, and the abrasive sheet 16 shown in FIGS. 1-7. The glove 12 is permanently connected to the barrier 14. The barrier 14 is releasably attached to the abrasive sheet 16.

Contrary to the embodiment shown in FIGS. 1-7, the tool 38 does not include a releasable adhesive between the barrier 14 and the abrasive sheet 16. Rather the barrier outer surface 28 is covered by a plurality of loops 40 and a mating surface 42 on the abrasive sheet 16 includes a plurality of hooks 44. The hooks 44 connect to the loops 40 to releasably attach the barrier 14 to the sheet 16 forming a hook and loop fastening system 46.

The hook and loop fastening system 46 is a conventional hook and loop fastening system, such as the hook and loop fastening system that is used with the Black & Decker® mouse sander provided by the Black & Decker Corporation of Towson, Md.

It should be understood that while the hook and loop fastening system 46 shown in FIGS. 10-11 illustrates the abrasive sheet 16 having a plurality of hooks and the barrier 14 having a plurality of loops, a hook and loop fastening system is contemplated in which an abrasive layer includes a plurality of loops and a barrier includes a plurality of hooks for use with the tool 38 disclosed in FIGS. 10-11.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A sanding glove comprising:

a glove body for receiving a hand of a user, said glove body having a palm portion, a plurality of finger portions, and a thumb portion, said finger portions and said thumb portion extending from said palm portion to form a continuous inner surface, an abrasive outer layer positioned over said glove body coextensive with said inner surface, a flexible barrier positioned between said abrasive outer layer and said glove body, said flexible barrier being permanently attached to said glove body, and means positioned between said flexible barrier and said abrasive outer layer for releasably attaching said abrasive outer layer to said flexible barrier to facilitate replacement of said abrasive outer layer from said glove body.

2. A sanding glove as set forth in claim 1 which includes:

said abrasive outer layer being die cut sandpaper.

3. A sanding glove as set forth in claim 1 which includes:

said abrasive layer being attached to said flexible barrier with an adhesive.

4. A sanding glove as set forth in claim 3 which includes:

said abrasive outer layer being die cut sandpaper.

5. A sanding glove as set forth in claim 1 which includes:

said abrasive layer being attached to said flexible barrier with hook and loop fasteners.

6. A sanding glove as set forth in claim 1 which includes:

said flexible barrier including a groove-free continuous outer surface adjacent to said abrasive outer layer to facilitate attachment of said abrasive outer layer to said flexible barrier.

7. A sanding glove as set forth in claim 1 which includes:

said flexible barrier having sufficient flexibility to allow said finger portions and said thumb portion to grasp an object.

8. A sanding glove as set forth in claim 7 which includes:

said flexible barrier having sufficient flexibility to allow said finger portions and said thumb portion to surround an object at least partially.

9. A sanding glove as set forth in claim 7 which includes:

said flexible barrier includes a pad that extends from said palm portion to said finger portions and said thumb portion to form said continuous inner surface.

10. A sanding device comprising:

a flexible glove including a palm portion, a back hand portion, and a plurality of digit receiving members connecting said palm to said back hand portion so that said glove essentially covers a hand of a user, a flexible barrier permanently attached to said flexible glove to cover said palm area and at least one side of each of said digit receiving members, an abrasive outer layer covering said flexible barrier, and means positioned between said flexible barrier and said abrasive outer layer for releasably connecting said abrasive outer layer to said flexible barrier to facilitate replacement of said abrasive layer.

11. A sanding device as set forth in claim 10 which includes:

said abrasive outer layer being die cut sandpaper.

12. A sanding device as set forth in claim 10 which includes:

said flexible barrier including a groove-free continuous outer surface positioned adjacent to said abrasive outer layer to facilitate attachment of said abrasive outer layer to said flexible barrier.

13. A sanding device as set forth in claim 10 which includes:

said flexible barrier having sufficient flexibility to allow said digit receiving members to grasp an object.

14. A sanding device as set forth in claim 13 which includes:

said flexible barrier having sufficient flexibility to allow a user to insert at least one finger into one of said digit receiving portions and a thumb into another digit receiving portion to surround an object at least partially.

15. A method for assembling a device for sanding an object comprising the steps of:

providing a sanding glove having a palm portion, a thumb portion, a plurality of finger portions, and a continuous surface extending from one side of the palm portion to the thumb portion and the finger portions, aligning a barrier layer having a groove-free outer surface in overlying relationship with the sanding glove continuous surface, permanently attaching the barrier layer to the sanding glove while providing the sanding glove with sufficient flexibility to allow the thumb portion and at least one of the finger portions to surround the object at least partially, and positioning between the barrier layer and an abrasive outer layer means for releasably attaching the abrasive outer layer having a plurality of abrasive particles to the flexible barrier groove-free outer surface so that the abrasive particles are coextensive with the glove continuous surface.

16. A method as set forth in claim 15 which includes:

positioning the glove to facilitate insertion of a thumb of a hand into the glove thumb portion, positioning the glove to facilitate insertion of a plurality of fingers from the hand into the glove finger portions, and covering a palm of the hand with the glove palm portion.

17. A method as set forth in claim 15 which includes:

releasably connecting a die cut sheet of sandpaper to the flexible barrier to form the abrasive layer.

18. A method as set forth in claim 15 which includes:

permanently attaching the barrier layer to the glove continuous surface with an adhesive.

19. A method as set forth in claim 15 which includes:

attaching a plurality of loops of a hook and loop fastener to the barrier layer and attaching a plurality of hooks of the hook and loop fastener to the abrasive outer layer to releasably attach the abrasive outer layer to the barrier layer.

* * * * *